US010941779B2

(12) United States Patent
Ye et al.

(10) Patent No.: US 10,941,779 B2
(45) Date of Patent: Mar. 9, 2021

(54) ABRASION RESISTANT INSERTS IN CENTRIFUGAL WELL PUMP STAGES

(71) Applicant: Baker Hughes, a GE Company, LLC, Houston, TX (US)

(72) Inventors: Zheng Ye, Claremore, OK (US); Ignacio Martinez, Tulsa, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 338 days.

(21) Appl. No.: 15/895,788

(22) Filed: Feb. 13, 2018

(65) Prior Publication Data

US 2018/0291907 A1 Oct. 11, 2018

Related U.S. Application Data

(60) Provisional application No. 62/482,812, filed on Apr. 7, 2017.

(51) Int. Cl.
*F04D 1/06* (2006.01)
*F04D 29/70* (2006.01)
(Continued)

(52) U.S. Cl.
CPC ..... *F04D 1/06* (2013.01); *F04D 1/063* (2013.01); *F04D 13/08* (2013.01); *F04D 13/10* (2013.01);
(Continued)

(58) Field of Classification Search
CPC .... F04D 29/0473; F04D 29/0413; F04D 1/06; F04D 13/08; F04D 29/04; F05D 2300/603; F05D 2300/61
(Continued)

(56) References Cited

U.S. PATENT DOCUMENTS 4,560,014 A * 12/1985 Geczy ..... E21B 4/00 175/107
4,678,399 A * 7/1987 Vandevier ..... F04D 29/167 415/104
(Continued)

OTHER PUBLICATIONS

International Search Report and Written Opinion dated Jun. 11, 2018 for corresponding PCT/US2018/019246.

*Primary Examiner* — David E Sosnowski
*Assistant Examiner* — Hakeem M Abdellaoui
(74) *Attorney, Agent, or Firm* — Bracewell LLP; James E. Bradley

(57) ABSTRACT

A centrifugal well pump assembly has a non-rotating diffuser between upper and lower rotating impellers. The upper impeller has a cylindrical skirt on a lower side that rotates within a diffuser receptacle. The lower impeller has a cylindrical balance ring on an upper side that rotates within a diffuser cavity. Impeller sleeves are bonded to the skirt and balance ring. Diffuser sleeves are bonded to the diffuser receptacle and cavity. The diffuser sleeves are of a harder material than the impeller sleeves. Each of the impeller sleeves has upper, intermediate and lower circumferential rows of inserts. Each insert has a face flush with the impeller sleeve and is in sliding engagement with one of the diffuser sleeves. The inserts in the intermediate row may be rotationally staggered relative to the inserts in the upper and lower rows to create serpentine flow paths for well fluid leakage.

13 Claims, 3 Drawing Sheets

(51) Int. Cl.

| | |
|---|---|
| ***F04D 29/04*** | (2006.01) |
| ***F04D 13/08*** | (2006.01) |
| ***F04D 29/047*** | (2006.01) |
| ***F04D 13/10*** | (2006.01) |
| ***F04D 29/041*** | (2006.01) |
| ***F04D 29/02*** | (2006.01) |

(52) U.S. Cl.
CPC ..... *F04D 29/026* (2013.01); *F04D 29/04* (2013.01); *F04D 29/0413* (2013.01); *F04D 29/0473* (2013.01); *F04D 29/708* (2013.01)

(58) Field of Classification Search
USPC ..... 384/122, 124, 135
See application file for complete search history.

(56) References Cited

U.S. PATENT DOCUMENTS 4,756,631 A * 7/1988 Jones ..... E21B 10/22 175/359
4,764,036 A * 8/1988 McPherson ..... E21B 4/003 175/320
4,892,420 A * 1/1990 Kruger ..... E21B 4/003 175/371
5,355,969 A * 10/1994 Hardy ..... B23B 27/146 175/432
5,722,812 A 3/1998 Knox et al.
5,827,042 A * 10/1998 Ramsay ..... F04D 3/02 415/112
6,012,900 A * 1/2000 Kennedy ..... F04D 29/0413 415/170.1
6,190,050 B1 2/2001 Campbell
7,399,122 B2 * 7/2008 Fujita ..... F16C 9/02 384/276
RE43,363 E 5/2012 Semple et al.
10,145,380 B1 * 12/2018 Davis ..... F04D 29/669
2004/0190804 A1 * 9/2004 John ..... F16C 33/043 384/420
2006/0204359 A1 * 9/2006 Semple ..... F04D 29/0413 415/170.1
2010/0166578 A1 * 7/2010 Watson ..... F16C 17/02 417/423.3
2012/0080230 A1 * 4/2012 Flores ..... F16C 37/00 175/57
2012/0107114 A1 * 5/2012 Brunner ..... F04D 29/0413 415/229
2013/0045078 A1 * 2/2013 Boldt ..... F01D 25/186 415/1
2013/0182980 A1 * 7/2013 Peterson ..... F16C 17/06 384/306
2015/0023815 A1 1/2015 Tetzlaff et al.
2015/0071799 A1 3/2015 Johnson et al.
2016/0222976 A1 * 8/2016 Watson ..... F04D 13/08
2017/0002823 A1 * 1/2017 Gahlot ..... F04D 29/0413
2017/0058616 A1 * 3/2017 Lunk ..... F04D 13/10
2019/0078414 A1 * 3/2019 Frazier ..... E21B 33/1291

* cited by examiner

ABRASION RESISTANT INSERTS IN CENTRIFUGAL WELL PUMP STAGES

CROSS REFERENCE TO RELATED APPLICATION

This application claims priority to provisional application Ser. No. 62/482,812, filed Apr. 7, 2017.

FIELD OF DISCLOSURE

The present disclosure relates to centrifugal pumps systems for well bore fluids. More specifically, the present disclosure relates to pump stages having sleeves with abrasion resistant inserts.

BACKGROUND

Operators commonly use electrical submersible well pumps to pump well fluids from hydrocarbon bearing wells. A typical well pump is a centrifugal type, having many stages, each stages having an impeller and a diffuser. The impellers and diffusers are usually castings formed of a nickel-iron alloy.

Some wells produce significant quantities of sand particles in the well fluid. The wear due to sand particles includes erosive wear, which usually happens in the flow paths of the impellers and diffusers. The wear also includes abrasive wear at the rotational interfaces that perform sealing functions for the well fluid flowing upward through the stages. One rotational interface occurs at the impeller skirt and another at the impeller balance ring. Abrasive wear is usually worse than erosive wear and results in increased recirculation through the stages. Recirculation due to abrasive wear degrades the pump performance. Also abrasive wear develops more quickly at higher rotational speeds.

Harder metal abrasion resistant components, such as those formed of tungsten carbide, have been incorporated in pump stages to reduce abrasive wear. A variety of different configurations for abrasion resistant components have been proposed and used.

SUMMARY

A well pump assembly has a plurality of modules including a pump and a motor. At least one of the modules has first and second components that rotate against each other. A plurality of inserts are imbedded in a body of the first component, each of the inserts having a face that is flush with a wear surface of the body of the first component. The inserts are formed of a harder material than the body of the first component. The second component has a body of a harder material than the body of the first component.

The body of the first component may be formed of a nickel iron alloy material. The inserts may be formed of tungsten carbide. The body of the second component may also be formed of tungsten carbide.

In one embodiment, the module having the rotating and non-rotating components comprises the pump. The first component of the pump may comprises an impeller, and the second component comprises a diffuser. In one embodiment, the body of the first component comprises a sleeve bonded to a cylindrical wall of the impeller. The body of the second component comprises a solid ring bonded to a cylindrical wall of the diffuser against which the faces of the inserts slide.

Each of the inserts may be embedded within a hole in the body of the first component that has a blind end. In the embodiment shown, each of the inserts has an insert axis that is normal to the face of each of the inserts. In one embodiment, each of the inserts has a cylindrical surface extending around the insert axis. In another embodiment, each of the inserts has a polygonal surface extending around the insert axis.

The body of the first component may comprise a cylindrical wall coaxial with a longitudinal axis and having inner and outer diameter surfaces. The wear surface is defined by one of the inner and outer diameter surfaces. Each of the inserts is embedded in the cylindrical wall and has an insert axis located on a radial line of the longitudinal axis. The face of each of the inserts is flush with one of the inner and outer diameter surfaces of the cylindrical wall.

The inserts may be located in first and second circumferential rows that circumscribe the cylindrical wall perpendicular to the longitudinal axis, the second circumferential row being below and adjacent the first circumferential row. In the embodiment shown, the insert axes in the first circumferential row are rotationally staggered with the insert axes of the inserts in the second row relative to the longitudinal axis.

The first component may comprise an outward-facing cylindrical wall, and the body may comprise a sleeve bonded to the outward-facing cylindrical wall of the first component, the sleeve having an outer diameter surface that defines the wear surface. The inserts may be located in blind holes that open to the outer diameter surface of the sleeve. The faces of the inserts are flush with the outer diameter surface of the sleeve.

The body of the first component may comprise a tubular down thrust bearing, the down thrust bearing having an outer diameter surface that defines a part of the wear surface. The down thrust bearing has a downward facing surface that defines another part of the wear surface. A first portion of the inserts are located in blind holes that are radial relative to a longitudinal axis of the down thrust bearing and open to the outer diameter surface of the down thrust bearing. The faces of the first portion of the inserts are flush with the outer diameter surface of the down thrust bearing. A second portion of the inserts are located in holes in the downward facing surface of the down thrust bearing. The faces of the second portion of the inserts are flush with the downward surface of the down thrust bearing.

Figure 1:
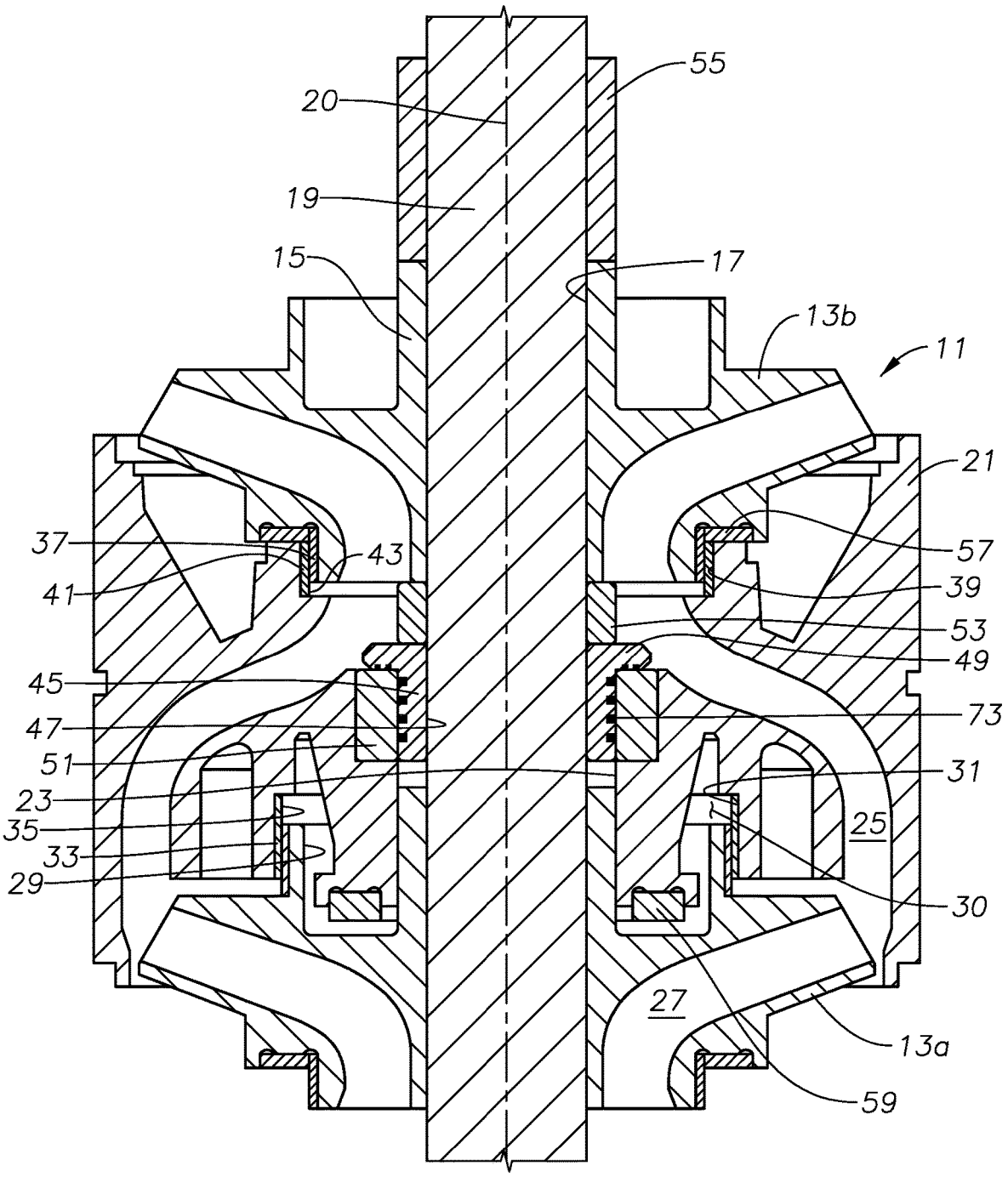
FIG. 1 is a sectional view of two impellers, a diffuser and a shaft of an electrical submersible pump having wear resistant rings in accordance with this disclosure.

While the disclosure will be described in connection with the preferred embodiments, it will be understood that it is not intended to limit the disclosure to that embodiment. On the contrary, it is intended to cover all alternatives, modifications, and equivalents, as may be included within the spirit and scope of the disclosure as defined by the appended claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a centrifugal pump stage 11 includes a lower or upstream impeller 13*a* having a hub 15 with a bore 17. A drive shaft 19 having a longitudinal or shaft axis 20 extends through bore 17. A key (not shown) engages axially extending grooves in bore 17 and on the outer diameter of shaft 19 to cause lower impeller 13*a* to rotate with shaft 19. The terms "upper". "lower" and the like are used only for convenience as the pump containing pump stage 11 may be operated in inclined and horizontal portions of a well.

Pump stage 11 has a non rotating diffuser 21. Diffuser 21 is in a stack of a large number of diffusers (not shown) that are secured within a cylindrical housing (not shown) of a pump. FIG. 1 shows lower impeller 13*a* on the lower side of diffuser 21, and an upper impeller 13*b* on the upper side of diffuser 21. Upper impeller 13*b* is part of the next upward stage from pump stage 11. Shaft 19 extends through a central bore 23 in diffuser 21. The upper portion of hub 15 of lower impeller 13*a* extends into diffuser central bore 23. The upper portion of impeller hub 15 of upper impeller 13*b* extends into the diffuser central bore 23 of the next upward diffuser 21 (not shown).

Diffuser 21 has a plurality of diffuser passages 25 that extend radially inward and upward from an intake area on the lower side to a discharge area on the upper side. Each impeller 13*a*, 13*b* has a plurality of impeller passages 27 that extend radially outward and upward from an intake area on the lower side to a discharge at the periphery on the upper side. Well fluid discharged from impeller passages 27 of lower impeller 13*a* flows into diffuser passages 25. Well fluid discharged from diffuser passages 25 flows into impeller passages 27 of upper impeller 13*b*.

Each impeller 13*a*, 13*b* has a cylindrical balance ring 29 integrally formed on its upper side that is concentric with longitudinal axis 20. Diffuser 21 has on its lower side an annular downward facing cavity 30 with an inward facing cylindrical wall 31 on an outer diameter of cavity 30. Balance ring 29 of lower impeller 13*a* extends into diffuser cavity 30 and is closely received by cavity inward facing wall 31, defining a sliding rotational interface. An abrasion resistant (hereinafter referred to as AR) balance ring sleeve 33 mounts to the outer diameter side of balance ring 29 for rotation therewith. AR balance ring sleeve 33 may be mounted or bonded to balance ring 29 in various manners, such as by a shrink-fit, by an adhesive, or by brazing.

An AR diffuser cavity ring or sleeve 35 may be fixed to diffuser cavity inward facing wall 31. AR diffuser cavity sleeve 35 may be secured to cavity inward facing wall 31 in various manners, such as by an adhesive or brazing. AR balance ring sleeve 33 is in in rotational sliding engagement with AR diffuser cavity sleeve 35. The sliding engagement stabilizes impeller 13*a* and also serves to reduce leakage of well fluid from diffuser cavity 30 downward through the interface between balance ring 29 and cavity inward facing wall 31.

Each impeller 13*a*, 13*b* has a cylindrical skirt 37 on its lower side. Skirt 37 of upper impeller 13*b* is closely received within a cylindrical receptacle 39 on an upper side of diffuser 21. Skirt 37 of lower impeller 13*a* is closely received with the cylindrical receptacle 39 of the next lower diffuser 21 (not shown). An AR skirt ring or sleeve 41 mounts to the outward facing cylindrical wall of each skirt 37 for rotation with impellers 13*b*, 13*a*. An AR receptacle ring or sleeve 43 may be fixed to the inward facing wall of diffuser receptacle 39. AR skirt sleeve 41 is in rotating sliding engagement with AR receptacle sleeve 43 and also serves to reduce leakage of well fluid through the interface between skirt 37 and diffuser receptacle 39.

In this example, pump stage 11 has an AR down thrust bearing 45 with an inner diameter 47 that closely receives shaft 19. AR down thrust bearing 45 is a tubular member, and in this example, it has an external flange 49 on its upper end. AR down thrust bearing 45 rotates with shaft 19 and can slide axially a limited extent relative to shaft 19. AR down thrust bearing 45 has an outer diameter surface that is in close, sliding reception with the inner diameter of a non-rotating AR bushing 51. AR bushing 51 is fixed within a counterbore in diffuser 21 and normally formed of a harder material than diffuser 21.

A lower spacer ring 53 may be located between the lower end of impeller hub 15 of upper impeller 13*b* and AR down thrust bearing 45 for transferring down thrust from upper impeller 13*b* to AR down thrust bearing 45, bushing 51 and diffuser 21. Flange 49 transfers the down thrust to the upper end of bushing 51 and is integrally formed with the cylindrical portion of down thrust bearing 45.

AR down thrust bearings 45 and AR bushings 51 may not be needed in every stage 11. For example, an upper spacer tube or ring 55 is shown on the upper end of the hub 15 of upper impeller 13*b* for receiving down thrust from impellers located above.

Pump stage 11 may have an impeller down thrust washer 57 on a lower end of upper impeller 13*b* for engaging an upper side of diffuser 21. An up thrust washer 59 may be located on a lower side of diffuser 21 for transferring up thrust from lower impeller 13*a* to diffuser 21.

Figure 2:
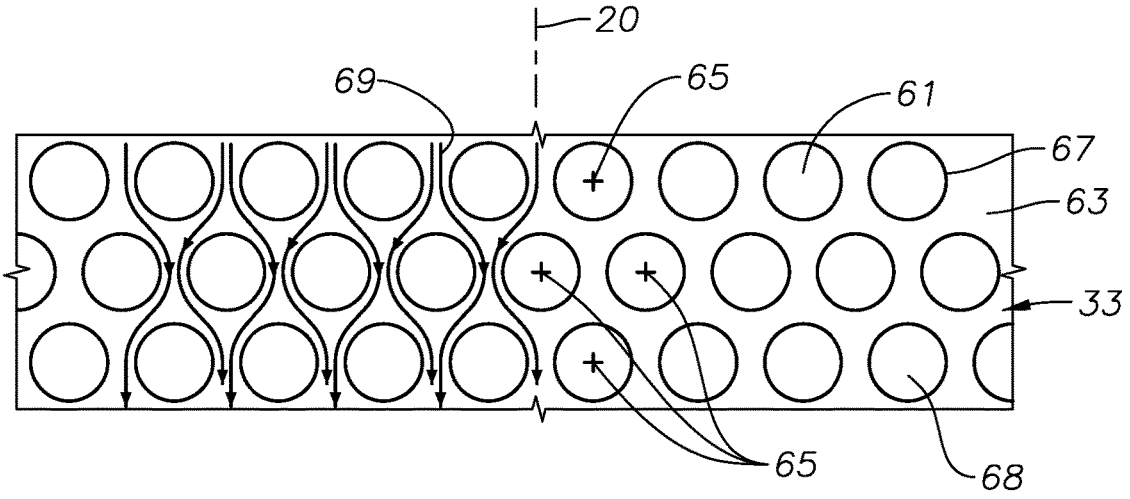
FIG. 2 is a side view of one of the impeller wear resistant rings of the pump of FIG. 1, shown removed from the impeller.

Referring to FIG. 2, AR balance ring sleeve 33 has an array of hard, wear resistant inserts 61 mounted in the side wall of a cylindrical body 63. Inserts 61 are of a material much harder than body 63. For example, inserts 61 may be formed of tungsten carbide, and body 63 may be formed of a metal similar or identical to the metal of impellers 13*a*. 13*b* (FIG. 1). One suitable material is an iron nickel alloy referred to as Ni-Resist. Impellers 13*a*, 13*b* are conventionally a casting of a Ni-Resist material. Having the same or similar material reduces hoop stress problems in AR balance ring sleeve 33 that might otherwise occur if the thermal coefficient of expansion of the material of impellers 13*a*, 13*b* were greater than the material of AR balance ring sleeve 33. Well temperatures during operation can be fairly high, such as several hundred degrees F.

Each insert 61 in this example is a generally cylindrical, short pin or rod with an insert axis 65 that will be located on a radial line of shaft axis 20 when AR balance ring sleeve 33 is installed. Each insert 61 shown in FIG. 2 has a cylindrical exterior 67 concentric with insert axis 65 and secured in a hole in body 63. Each insert 61 has a face 68 that is initially flush with the cylindrical exterior of body 63. Face 68 may be flat or slightly curved to match the cylindrical exterior of body 63. The radial thickness of body 63 between its inner and outer diameters may be slightly greater than the radial length of each insert 61. The inner ends of inserts 61 opposite faces 68 need not extend to the inner diameter of body 63.

In one manufacturing technique, blind holes are drilled in body 63 for inserts 61, then inserts 61 are inserted in the holes. The inserts 61 may be secured by an interference fit, adhesive or brazing.

In another technique, inserts 61 are formed in a mesh that fixes the inserts in the cylindrical pattern shown in FIG. 2. Three-dimensional printing or fabrication techniques may be used to form the mesh of inserts 61. Thin webs join inserts 61 to each other while in the mesh. Material used to form body 63 will be heated to a molten state; the molten metal of body 63 will be injected through and around the mesh while within a mold, casting the inserts 61 in place.

The pattern or arrangement of inserts 61 in body 63 may vary. In this example, circumferential rows of inserts 61 extend around body 63 perpendicular to shaft axis 20. The inserts 61 in each circumferential row are rotationally offset from those in adjacent circumferential rows. For example, if three rows are employed as illustrated, the insert axis 65 of an insert 61 in the intermediate row is rotationally offset equally between the axes 65 of the closest inserts 61 in the upper and lower rows. In this example, the axes 65 of inserts 61 in the upper row and lower row are aligned axially with each other. That is, a line perpendicular to shaft axis 20 and extending from insert axis 65 of one insert 61 in the upper row will pass through insert axis 65 of one insert 61 in the lower row. That line would not pass through the insert axis 65 of any insert 61 in the intermediate row. The axes 65 of inserts 61 in the intermediate row are circumferentially spaced or rotationally staggered from the axes 65 in the middle and upper rows.

AR skirt sleeve 41 (FIG. 1) may be identical to AR balance ring sleeve 33, other than dimensions, also having abrasion resistant inserts installed in a softer metal body. AR diffuser cavity sleeve 35 and AR diffuser receptacle sleeve 43 may be formed of solid tungsten carbide. Optionally, AR cavity sleeve 35 and AR diffuser receptacle sleeve 43 may have hard, wear resistant inserts within a softer metal body as described above for AR skirt sleeve 41 and AR balance ring sleeve 33.

During operation, faces 68 of inserts 61 of AR balance ring sleeve 33 will be in sliding rotational engagement with AR diffuser cavity sleeve 35. Faces 68 of inserts 61 of AR skirt sleeve 41 will be in sliding rotational engagement with AR diffuser receptacle sleeve 43. Some leakage of well fluid past the AR balance ring sleeve 33 and the AR skirt sleeve 41 will occur. The well fluid being pumped often has sand particles, making it abrasive. The abrasive well fluid causes much more wear to the cylindrical exterior of body 63 than to faces 68 of inserts 61. The wear of body 63 results in insert faces 68 beginning to protrude from the eroded exterior surface of body 63. Well fluid flow paths 69 will develop along the eroded cylindrical exterior of body 63 from an upper side to a lower side. The flow paths 69 will be in a sinuous form passing around the cylindrical exteriors 67 of inserts 51. The sinuous form slows the flow rate of well fluid leaking along flow paths 69, retarding wear to the cylindrical exterior of body 63.

Figure 3:
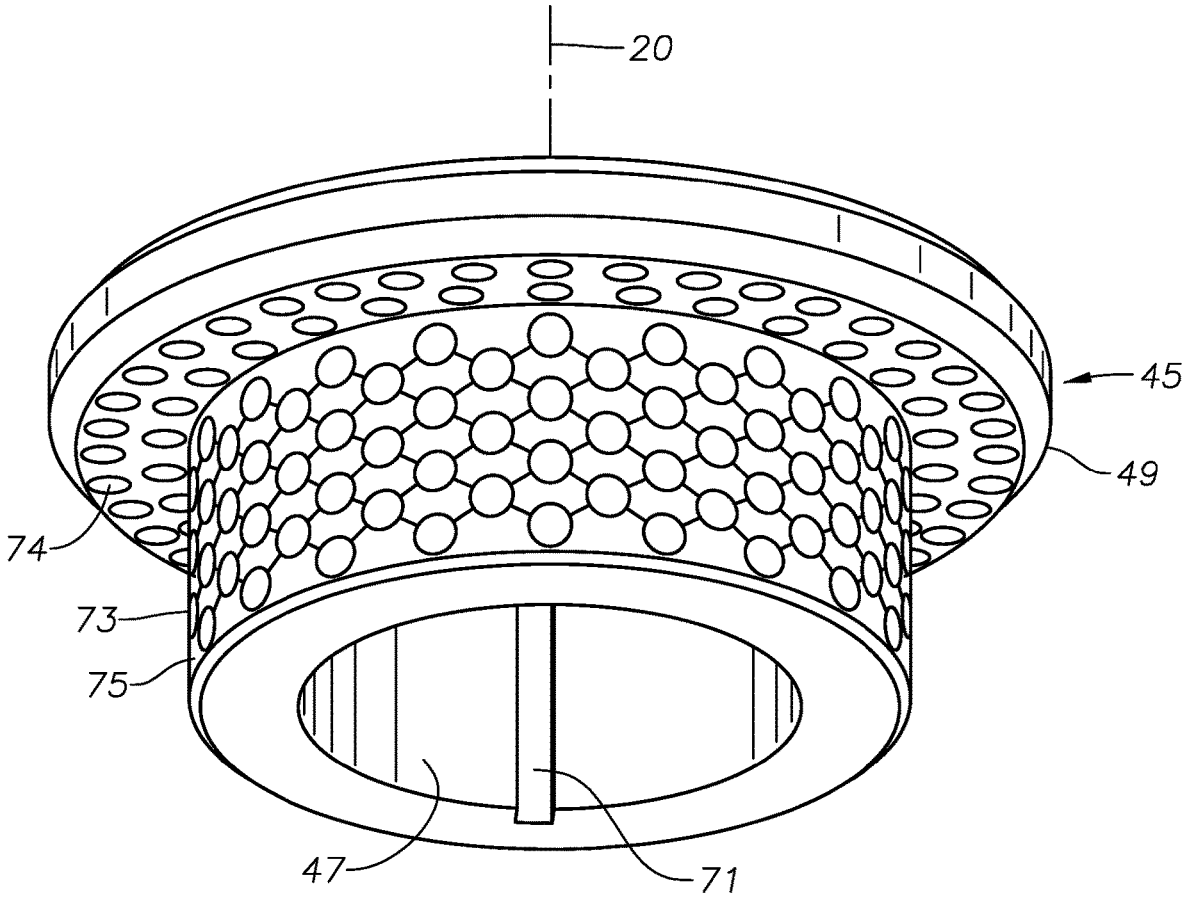
FIG. 3 is a perspective view of the shaft wear resistant ring of the pump of FIG. 1, shown removed from the shaft.

Referring to FIG. 3, inner diameter 47 of down thrust bearing 45 has an axially extending groove 71. A key (not shown) fits within groove 71 and a mating groove (not shown) on shaft 19 (FIG. 1). Down thrust bearing 45 rotates with shaft 19, but is able to slide a short distance axially relative to shaft 19. A first portion of inserts in down thrust bearing comprises inserts 73 of a hard, wear resistant material such as tungsten carbide. Inserts 73 are embedded in cylindrical body 75 of down thrust bearing 45. Inserts 73 may differ in dimensions but may otherwise be identical to inserts 61 (FIG. 2). Cylindrical body 75 and its integral flange 49 are formed of a softer material than inserts 73, and also preferably softer than the material of shaft 19 (FIG. 1). For example, a Ni-Resist material of the same type as body 63 (FIG. 2) may be suitable.

As in FIG. 2, inserts 73 are short cylindrical rods, each with an insert axis that will be located on a radial line of shaft axis 20. Inserts 73 have lengths less than the radial thickness of body 75. The face of each insert 73 is initially flush with the exterior cylindrical surface of body 75. The inner ends of inserts 73 do not extend to the inner diameter 47 of down thrust bearing 45. This arrangement places the softer material of cylindrical body 75 in contact with shaft 19 (FIG. 1), reducing the chances for damage to the exterior of shaft 19 to occur. The inner ends of inserts 73 will not be in contact with the exterior surface of shaft 19. The faces or outer ends of inserts 73 will be in rotating sliding engagement with the inner diameter of AR bushing 51 (FIG. 1), which is normally formed of tungsten carbide.

A second portion of inserts in down thrust bearing 45 comprises down thrust inserts 74, which may be identical to inserts 73. Inserts 74 may be embedded in blind holes in flange 49 in the same manner as inserts 73 within cylindrical body 75. Inserts 74 in flange 49 have lower ends that are flush with the lower or downward facing side of flange 49 for engaging the upper end of bushing 51 (FIG. 1). The axes of inserts 74 in flange 49 are parallel to shaft axis 20 (FIG. 1). Inserts 74 extend in one or more circumferential rows around the lower side of flange 49.

The circumferential rows of cylindrical body inserts 73 may be rotationally staggered in the same manner as the rows of inserts 61 (FIG. 2). Well fluid leakage paths similar to flow paths 69 (FIG. 2) will develop during operation. Inserts 73, 74 may be installed in cylindrical body 75 and flange 49 in the same manner as inserts 61 in body 63 (FIG. 2).

Figure 4:
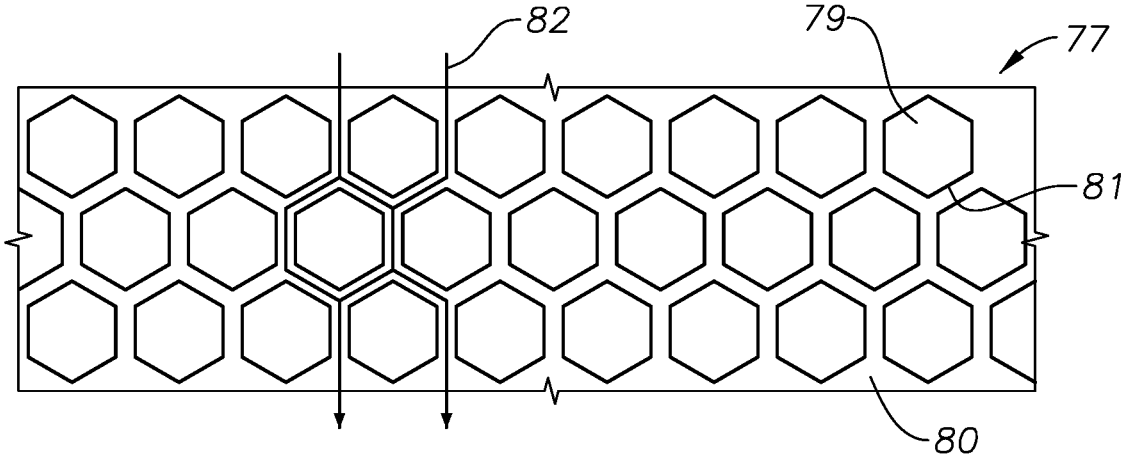
FIG. 4 is a side view of an alternate embodiment of the wear resistant rings of the pump of FIG. 1.

FIG. 4 shows an alternate embodiment for AR balance ring sleeve 33, and also for AR skirt sleeve 41 and down thrust bearing 45. AR sleeve 77 has inserts 79 in an array within a body 80. Inserts 79 and body 80 are of the same materials as inserts 61 and body 63 of FIG. 2. Each insert 79 has an exterior 81 extending between its inner and outer ends that is polygonal, and in this embodiment, the exterior is hexagonal. The staggered circumferential rows of inserts 79 create flow paths 82 from the upper end to the lower end of AR ring 77 similar to flow paths 69 of FIG. 2. That is, the flow paths 82 between the rows of inserts 79 are not along straight lines parallel to shaft axis 20 (FIG. 1). Flow paths 82 are slightly longer than flow paths 69 even if the circumscribed diameters of hexagonal inserts 79 are the same as the diameters of cylindrical inserts 69.

Figure 5:
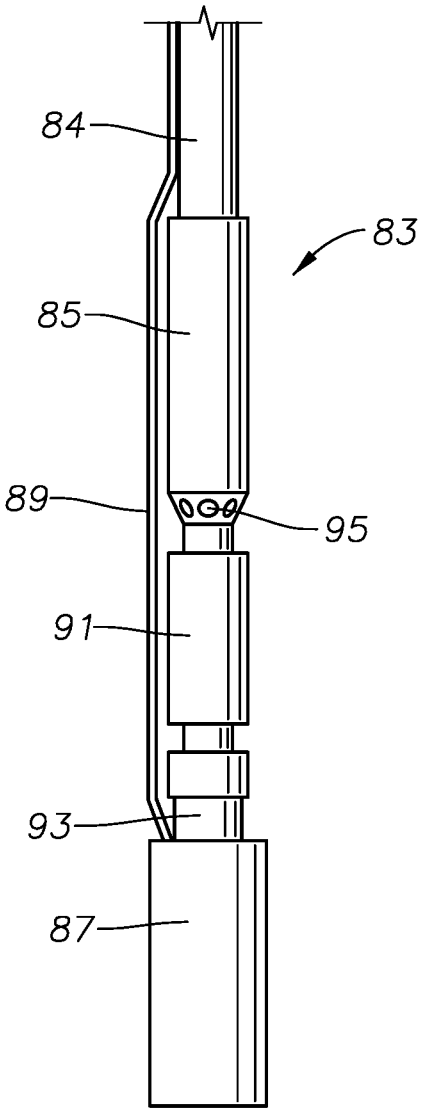
FIG. 5 is a side view of an electrical submersible pump assembly having wear resistant rings in accordance with this disclosure.

FIG. 5 schematically shows an example of an electrical submersible pump assembly (ESP) 83 suspended on a string of production tubing 84. ESP 83 has a centrifugal pump 85 that is driven by an electrical motor 87. A motor lead 89 from motor 87 connects to a power cable (not shown) that extends alongside production tubing 84 to a wellhead at the upper end of a well. A seal section 91 for sealing the interior of motor 87 from well fluid may be located between motor 87 and pump 85. Seal section 91 may also have pressure equalizing components for reducing a pressure differential between lubricant in motor 87 and well fluid on the exterior. A thrust bearing assembly 93, which may be a separate unit or located in seal section 91, handles thrust imposed on pump shaft 19 (FIG. 1). Pump 85 has an intake 95 for drawing in well fluid to pump up production tubing 84. Pump stage 11 (FIG. 1) is one of many stages located within the housing of pump 85.

The present disclosure described herein, therefore, is well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the scope of the appended claims.

For example, rather than mount the balance ring inserts 61 in a separate sleeve 33, they could be mounted directly in holes in impeller balance ring 29. A separate sleeve 33 would not be required. Rather, the abrasion resistant balance ring, after installation of the inserts, would be the balance ring itself. Also, the abrasion resistant inserts in skirt sleeve 41 could be mounted directly in holes in impeller skirt 37. A separate sleeve containing inserts would not need to be mounted to impeller skirt 37 in that instance. The abrasion resistant skirt, after installation of the inserts, would be the impeller skirt itself. In addition, abrasion resistant inserts of a type described above could be mounted in other places in the pump stages, such as in the impeller down thrust washer 57 and up thrust washer 59.

Also, although the abrasion resistant inserts have been shown only centrifugal pump stages, they could also be applied to components of other modules of a submersible pump assembly, such as pump shaft radial bearings, magnetic coupling bearings, motor radial bearings, and shaft thrust bearings.

The invention claimed is:

1. A well pump assembly, comprising: a pump—the pump having first and second components that rotate against each other, one of the components being an impeller formed of an iron-nickel alloy and the other of the components being a diffuser formed of an iron-nickel alloy; a sleeve of an iron-nickel alloy bonded to one of the components, the sleeve having a cylindrical side wall; a solid ring of tungsten carbide bonded to the other of the components; a plurality of tungsten carbide inserts imbedded in the cylindrical side wall of the sleeve, each of the inserts having a face that is flush with—a the cylindrical side wall of the sleeve and is in rotating sliding engagement with the solid ring; wherein, the inserts are spaced circumferentially around the cylindrical side wall of the sleeve in an upper row, a lower row and an intermediate row between the upper and lower rows; the inserts within the intermediate row are rotationally offset from the inserts in the upper row and in the lower row, defining serpentine flow paths in the cylindrical side wall from the upper row to the lower row in response to well fluid leaking between the sleeve and the solid ring and eroding portions of the cylindrical side wall between the inserts.

2. The assembly according to claim 1 wherein:

each of the inserts is embedded within a hole in the cylindrical side wall of the sleeve has a blind end.

3. The assembly according to claim 1, wherein:

each of the inserts has an insert axis that is normal to the face of each of the inserts; and each of the inserts has a cylindrical surface extending around the insert axis.

4. The assembly according to claim 1, wherein:

each of the inserts has an insert axis that is normal to the face of each of the inserts; and each of the inserts has a polygonal surface extending around the insert axis.

5. The assembly according to claim 1, wherein:

the sleeve is bonded to the impeller and the solid ring is affixed to the diffuser.

6. The assembly according to claim 1, wherein:

the inserts are located in blind holes that open to an outer diameter surface of the sleeve.

7. A well pump assembly, comprising:

a centrifugal pump having a drive shaft with a longitudinal axis and a plurality of stages;

a motor operatively coupled to the pump;

each of the stages having first and second cylindrical walls in rotational sliding engagement with each other;

a plurality of cylindrical wall inserts embedded in the first cylindrical wall, each of the cylindrical wall inserts having a face that is flush with the first cylindrical wall and in rotating sliding engagement with the second cylindrical wall; wherein the cylindrical wall inserts are spaced circumferentially around the first cylindrical wall in an upper row, a lower row and an intermediate row between the upper and lower rows; the cylindrical wall inserts within the intermediate row are rotationally offset from the cylindrical wall inserts in the upper row and in the lower row, defining serpentine flow paths in the first cylindrical wall from the upper row to the lower row in response to well fluid leaking between the first and second cylindrical walls and eroding portions of the first cylindrical wall between the inserts cylindrical wall inserts are formed of a harder material than the first cylindrical wall and the second cylindrical wall is free of inserts and formed of a harder material than the first cylindrical wall; wherein the first cylindrical wall comprises an exterior surface of a down thrust bearing; and the second cylindrical wall comprises an interior surface within a bushing an external flange on the down thrust bearing having a downward facing surface in rotational sliding engagement with an upward facing surface on the bushing;

a plurality of down thrust inserts mounted in the flange, each of the down thrust inserts having a face in rotational sliding engagement with the upward facing surface on the bushing; and each of the down thrust inserts being formed of a harder material than the flange.

8. The assembly according to claim 7, wherein the second cylindrical wall, the cylindrical wall inserts, and the down thrust inserts are formed of tungsten carbide.

9. The assembly according to claim 7, wherein:

one of the first and second cylindrical walls comprises a skirt of an impeller;

the other of the first and second cylindrical walls comprises a receptacle of a diffuser;

the material of the first cylindrical wall is the same as the material of the impeller; and the material of the second cylindrical wall is the same as the material of the diffuser.

10. The assembly according to claim 7, wherein:

one of the first and second cylindrical walls comprises a balance ring of an impeller; and the other of the first and second cylindrical walls comprises a diffuser cavity of a diffuser.

11. A well pump assembly, comprising:

a centrifugal pump having a drive shaft with a longitudinal axis and a plurality of stages, each of the stages having an impeller and a diffuser;

a motor operatively coupled to the pump;

each of the impellers having a skirt and each of the diffusers having a receptacle, the skirt and the receptacle defining first and second cylindrical walls in rotational sliding engagement with each other;

the first cylindrical wall being of a softer material than the second cylindrical wall;

each of the impellers having a balance ring and each of the diffusers having a diffuser cavity, the balance ring and the diffuser cavity defining third and fourth cylindrical walls in rotational sliding engagement with each other;

the third cylindrical wall being of same material as the first cylindrical wall, and the fourth cylindrical wall being of the same material as the second cylindrical wall;

a plurality of first cylindrical wall inserts embedded in the first cylindrical wall, each of the first cylindrical wall inserts having a face that is flush with the first cylindrical wall and in rotating sliding engagement with the second cylindrical wall, the first cylindrical wall inserts being formed of harder material than the first cylindrical wall;

a plurality of third cylindrical wall inserts embedded in the third cylindrical wall, each of the third cylindrical wall inserts having a face that is flush with the third cylindrical wall and in rotating sliding engagement with the fourth cylindrical wall, the third cylindrical wall inserts being formed of a harder material than the third cylindrical wall; wherein the first cylindrical wall inserts are spaced circumferentially around the first cylindrical wall in an upper row, a lower row and an intermediate row between the upper and lower rows;

the first cylindrical wall inserts within the intermediate row are rotationally offset from the first cylindrical wall inserts in the upper row and in the lower row, defining serpentine flow paths in the first cylindrical wall from the upper row to the lower row in response to well fluid leaking between the first and second cylindrical walls and eroding portions of the second cylindrical wall;

the third cylindrical wall inserts are spaced circumferentially around the third cylindrical wall in an upper row, a lower row and an intermediate row between the upper and lower rows; and the third cylindrical wall inserts within the intermediate row are rotationally offset from the third cylindrical wall inserts in the upper row and in the lower row, defining serpentine flow paths in the third cylindrical wall from the upper row to the lower row in response to well fluid leaking between the third and fourth cylindrical walls and eroding portions of the third cylindrical wall.

12. The assembly according to claim 11, wherein:

the second and fourth cylindrical walls and the first and third cylindrical wall inserts are formed of tungsten carbide.

13. The assembly according to claim 11, wherein:

the impellers and the diffusers are formed of an iron-nickel alloy material; and the first and third cylindrical walls are also formed of an iron-nickel alloy material.

* * * * *